US005268672A

United States Patent [19]

Kerr

[11] Patent Number: 5,268,672

[45] Date of Patent: Dec. 7, 1993

[54] INTRUSION DETECTION SYSTEM INCORPORATING DEFLECTION-SENSITIVE COAXIAL CABLE MOUNTED ON DEFLECTABLE BARRIER

[75] Inventor: Reginald J. Kerr, Delta, Canada

[73] Assignee: Hitek-Protek Systems Incorporated, Toronto, Canada

[21] Appl. No.: 756,206

[22] Filed: Sep. 9, 1991

[51] Int. Cl.[5] ..... G08B 13/00

[52] U.S. Cl. ..... 340/565; 340/668

[58] Field of Search ..... 340/541, 565-566, 340/668, 529, 825.77; 73/763; 256/10

[56] References Cited

U.S. PATENT DOCUMENTS

| | | | |
|---|---|---|---|
| 2,345,771 | 4/1944 | Reynolds | 340/566 |
| 2,787,784 | 4/1957 | Meryman et al. | 340/565 X |
| 3,234,787 | 2/1966 | Ruge | 73/141 |
| 3,750,127 | 7/1973 | Ayers et al. | 340/566 X |
| 4,107,660 | 8/1978 | Chleboun | 340/566 |
| 4,155,083 | 5/1979 | Slaats et al. | 340/666 |
| 4,209,776 | 6/1980 | Frederick | 340/541 |
| 4,223,304 | 9/1980 | Barowitz et al. | 340/566 |
| 4,306,228 | 12/1981 | Meyer | 340/566 |
| 4,307,387 | 12/1981 | Baxendale | 340/566 |
| 4,319,397 | 3/1982 | Tanabe et al. | 29/589 |
| 4,327,593 | 5/1982 | Porat | 73/862.68 |
| 4,333,093 | 6/1982 | Raber et al. | 340/566 |
| 4,365,239 | 12/1982 | Mongeon | 340/564 |
| 4,367,459 | 1/1983 | Amir et al. | 340/541 |
| 4,386,343 | 5/1983 | Shiveley | 340/566 |
| 4,468,763 | 8/1984 | Braunling et al. | 367/136 |
| 4,500,873 | 2/1985 | Porat et al. | 340/515 |
| 4,521,768 | 6/1985 | Haran et al. | 340/566 |
| 4,527,150 | 7/1985 | Porat | 340/541 |
| 4,533,906 | 8/1985 | Amir | 340/541 |
| 4,591,834 | 5/1986 | Kyle | 340/566 |
| 4,742,338 | 5/1988 | Baxendale | 340/566 |
| 4,764,756 | 8/1988 | Van Thematt | 340/566 |
| 4,829,287 | 5/1989 | Kerr et al. | 340/541 |
| 4,912,455 | 3/1990 | Pharaoh | 340/541 |
| 4,929,926 | 5/1990 | Porat | 340/541 |

FOREIGN PATENT DOCUMENTS

| | | |
|---|---|---|
| 967259 | 5/1975 | Canada . |
| 1273428 | 8/1990 | Canada . |

OTHER PUBLICATIONS

Information Sheet/Vindicator Corporation Locator TW-3000/Taut Wire Alarm No. of pages : 10.

*Primary Examiner*—John K. Peng
*Assistant Examiner*—Thomas J. Mullen, Jr.
*Attorney, Agent, or Firm*—Moss, Barrigar & Oyen

[57] ABSTRACT

An intrusion detection system for a space secured in part by a deflectable physical barrier includes a cable sensor mounted on the barrier in such manner that it stretches and flexes in response to deflection of the barrier, thereby to produce an output signal representing such movement. A signal processor receives the signal from the coaxial cable and provides an output affirmative signal if the amplitude of the cable signal, within a predetermined frequency range lying below about 30 Hz, exceeds a predetermined level for a predetermined time interval.

22 Claims, 3 Drawing Sheets

INTRUSION DETECTION SYSTEM INCORPORATING DEFLECTION-SENSITIVE COAXIAL CABLE MOUNTED ON DEFLECTABLE BARRIER

FIELD OF INVENTION

This invention relates to intrusion detection systems for detecting human intrusion into a secured space.

BACKGROUND OF THE INVENTION

Intrusion detection systems are of a wide variety of types. The type with which the present invention is concerned is the type that detects human movement against a barrier.

Various systems of the foregoing general type are known. For example, taut wire detection systems of the sort described in U.S. Pat. No. 4,829,287 (Kerr et al., May 9, 1989) comprise a perimeter fence having tautly strung wires on fixed posts, which wires in turn are connected to sensors. Various suitable sensors for taut wire perimeter detection systems are known; in each case the vibration of the taut wire conveyed to a sensor element produces an output electrical signal. Suitable sensor elements described in the prior literature include materials whose resistance changes with applied force, piezo-electric crystals, and the like.

Various other intrusion detection systems are known which respond to vibrations of various kinds, even seismic vibrations, exemplary literature including U.S. Pat. No. 4,107,660 (Chleboun, Aug. 15, 1978) and U.S. Pat. No. 4,223,304 (Barowitz, Sep. 16, 1980). The Barowitz patent additionally discloses the use of a two-channel signal processing system, each channel tuned to a narrow frequency band. One channel is centred on 33 Hz and the other on 100 Hz. By contrast, Chleboun looks at frequencies of a seismic range (10 to 100 Hz) and frequencies of a pressure range (less than 1 Hz).

It is also known that so-called noisy coaxial cables may be fixed to rigid plates for use as signal generators in response to mechanical vibrations of the rigid plates. This kind of intrusion detection system is not a barrier-type system, but rather is suitable for use at such locations as railway stations in which intrusion of a human onto or in the vicinity of a railway track may result in injury to the human. As a consequence of impact on or deflection of the plate, an alarm is generated, so that oncoming trains may be halted or other remedial measures taken. Such a system is described for example in Canadian Patent No. 1,273,428 (Kerr, Aug. 28, 1990).

The GTE-Sylvania (trademark) FPS-1 intrusion detection system includes a noisy coaxial cable connected to signal-processing circuitry that responds to vibrations in an audible range, say of the order of a few hundred Hz. The Stellar E-Flex (trademark) system is similarly designed. Known coaxial cables of this type are referred to as "noisy" because of their relatively loose construction, permitting slippage of the inner and outer conductors relative to one another. Such relative movement of the inner and outer conductors causes a change in the electrical characteristics (notably the impedance) of the cable, thereby generating a detectable signal that varies in dependence upon such relative movement.

While the aforementioned intrusion detection systems all offer some degree of utility, they tend to suffer from a number of common failings.

First, many of the barrier-type systems require specially constructed barriers, generally of a rigid or semi-rigid (e.g. taut) character. Such systems cannot effectively be used with conventional physical barriers such as coiled barbed wire, chain-link fencing, or the like.

Second, the frequency ranges selected are often inappropriate for optimum detection of human intrusion.

Third, partly because special physical constituents are often required to form the barrier, such intrusion detection systems tend to be expensive to manufacture and install.

Another problem with previously known systems is the problem of false alarms, which tends to be a persistent problem difficult to remedy. The more sensitive a system is, the more likely it is to produce false alarms unless counter-measures are taken. It is known in the prior art to select for further processing only certain frequencies of interest and to eliminate at least some spurious signals by passing them through a delay circuit which rejects signals that do not persist for more than some predetermined period of time. The result is that only signals within a frequency band of interest that have an amplitude exceeding a threshold amplitude during a period of time that exceeds some threshold time interval are capable of producing an output alarm signal.

SUMMARY OF THE INVENTION

It is an objective of the present invention to provide an intrusion sensor that can be used with conventional physical barriers such as coiled barbed wire, chain-link fencing, or the like, which does not require any specially constructed barrier to be used that has to be integrated with the system, and which is used in conjunction with signal-processing circuitry suitable for generating an alarm in response to vibrations of a relatively low frequency, most likely to indicate reliably an intrusion.

To this end, to a conventional physical barrier of the type capable of at least some degree of deflection without undue damping in response to intrusive movement, is attached, preferably at spaced intervals, a length of coaxial cable which acts as a sensor for sensing movement. The cable is mounted on the barrier by any convenient conventional mounting device, e.g. by wire ties, at points along the length of the barrier, in such a manner that the cable will flex and stretch, thereby deforming the cable, so as to produce an output electric signal (which is caused by relative movement of the inner conductor and the outer conductive sheath of the coaxial cable). A signal processor connected to one end of the coaxial cable receives the output signal from the cable and provides an alarm signal if certain threshold conditions persist. Typically, these threshold conditions will reflect a human intrusion and not merely spurious noise such as wind vibration or the like.

Since we have found that typical human intrusion events at such deflectable barriers create frequency nodes or peaks at frequencies below about 20 Hz, it is desirable that the signal processor should respond to frequencies lying within the frequency range 0 to about 20 Hz. Since frequencies below about 1 Hz are seldom of interest for reliable intrusion detection at such barriers, signals below 1 Hz may be filtered out if desired.

In appropriate cases, a multiplicity of frequency channels may be examined for the various constituents of the output signal of the coaxial cable sensor, and logic circuitry employed to compare the various outputs of the various channels against a set of criteria that, if satisfied, bring about an alarm condition. The output alarm signal can be connected directly to an alarm device, or may be used to trigger directly other physical events such as door closing and locking, the turning-on of electric lights, etc. The present invention is not concerned with the specifics of the alarm, nor of the criteria that may be judged suitable to create an alarm. Rather, the present invention is concerned with the upstream portion of the intrusion detection system for use with the physical barrier itself, viz. the sensor (strain-sensitive coaxial cable) used with the physical barrier, and the means of utilizing the cable's output electrical signal to provide a useful alarm-generating output at the low frequencies described (optionally, other frequencies may be examined as well).

In addition to known techniques for preventing false alarms, in another aspect the present invention adds a further refinement, namely, the selection of a coaxial cable that itself attenuates signals within various frequency ranges. Coaxial cable are readily available, for example, that attenuate frequencies above about 100 Hz.

DETAILED DESCRIPTION

Figure 1:
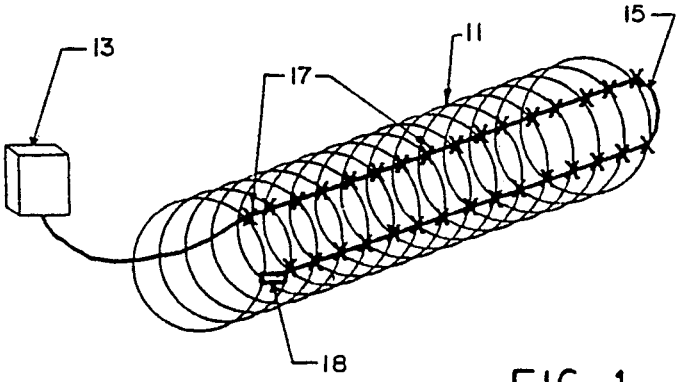
FIG. 1 is a schematic diagram of a coiled barbed wire barrier upon which is mounted a coaxial cable sensor in accordance with the teachings of the present invention.

Referring to FIG. 1, a conventional coiled barbed wire barrier 11, which may for example be secured to the top of a wall, provides a physical impediment to entry into secured premises. Attached to the barbed wire coil 11 at intervals along the length of the coil by wire ties 17 or other suitable fasteners is a coaxial cable 15 of the type previously described, viz. one that produces an output signal in response to relative movement of the inner conductor and outer conductive sheath. Such coaxial cables are known and have been previously described in the literature, as for example in the aforementioned Canadian Patent No. 1,273,428, and have been used in commercial apparatus, such as the aforementioned Stellar E-Flex and GTE Sylvania FPS-1 systems. A suitable coaxial cable should be uniformly noisy over its length. It will be found to generate, in response to low-frequency vibrations, output signals of the order of 20 MV.

The coaxial cable may, if desired, be selected to have frequency-selective properties. The cable itself is inherently capacitive; when terminated by a conventional terminal resistor, it acts as an RC filter. We have established that human intrusion of the type occurring by bumping into or climbing over a deflectable fence or barrier, typically includes relatively low frequencies under about 20 Hz. It may be found that other characteristic frequencies are also likely to be associated with any particular barrier, e.g. coiled barbed wire, and indeed there may be some variation in the frequency characteristics of a given act of intrusion, depending upon the physical characteristics of the coiled barbed wire barrier. However, we have found that frequencies of the order of 30 Hz or less are invariably of interest in intrusion situations involving deflectable barriers, and consequently the selection of coaxial cable which, acting as an RC filter, naturally attenuates frequencies of over, say, about 100 Hz, will facilitate the rejection of unwanted frequencies in downstream signal processing.

The manner of attachment of the coaxial cable 15 to the barbed wire coil 11 can be in accordance with the system designer's preference. Any conventional clip or wire tie or other fastener may be employed which is suitable to the physical characteristics of the cable and the barbed wire coil. All that is required is that the cable 15 be mounted on the barbed wire coil 11 in such a manner that when the coil deflects in response to human intrusion, the coaxial cable 15 will flex and stretch so as to deform the cable, thereby generating an electrical signal by reason of the relative movement of the inner conductor and the outer conductive sheath of the coaxial cable 15.

One end of the coaxial cable 15 is connected to signal processing circuitry (not shown in FIG. 1, to be discussed further below) that may be enclosed in a control box 13 located conveniently at one end of the barbed wire coil 11 or elsewhere, as the designer may select. The other end of the cable 15 is connected to a conventional terminal resistor 18, e.g. a 1-Megohm resistor.

Figure 2:
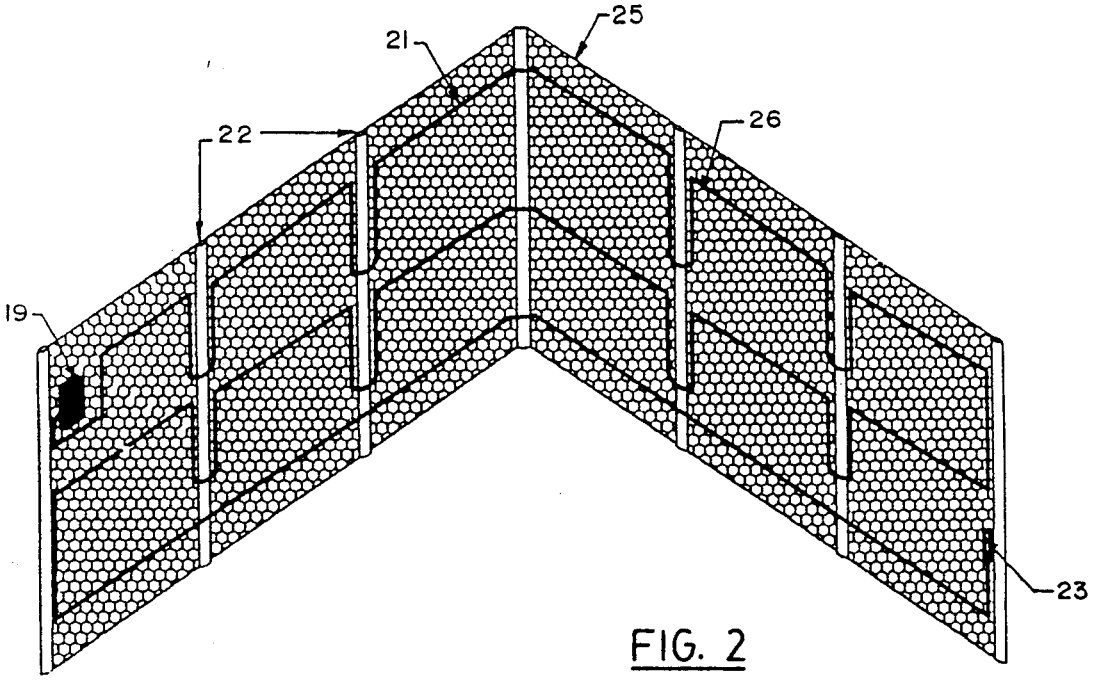
FIG. 2 is a schematic depiction of a chain link fence on which is mounted an array of coaxial cable sensors for an intrusion detection system conforming to the principles of the present invention.

FIG. 2 illustrates a chain link fence, generally indicated by reference numeral 25. Three vertically spaced runs of a coaxial cable 21 are mounted on and extend generally horizontally along the chain link fence 25 in one direction from a control box 19, thereby to provide complete coverage of the secured area fenced in by the chain link fence 25. The chain link fence 25 itself provides a physical barrier to entry. The coaxial cable 21 may be fixed to the chain link fence at spaced horizontal intervals by suitable clips, ties, or fasteners such as the wire ties 17 of FIG. 1, such that any deflection of the chain link fence will result in a flexing and stretching of the coaxial cable 21, thereby to generate an electrical signal which is picked up and processed by the signal-processing circuitry contained in control box 19. The cable 21 ends in a suitable terminal resistor 23. The cable may, if desired, extend 26 over portions of fence 25 in a vertical direction in the vicinity of fence-posts 22 so as more readily to detect vibration at these locations.

Figure 3:
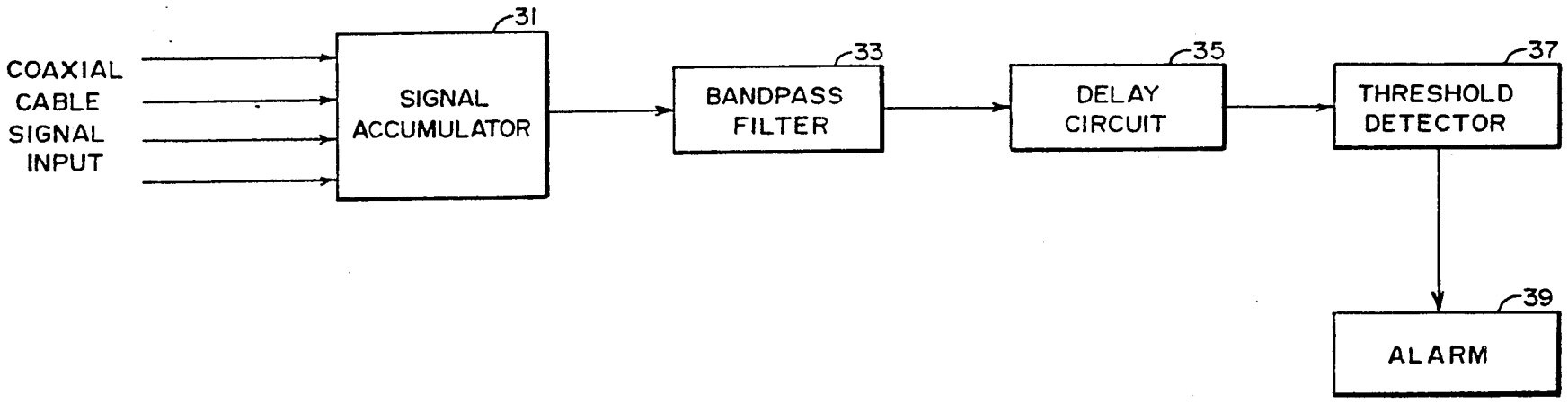
FIG. 3 is a block diagram for relatively simple electronic circuitry capable of implementing the principles of operation of an intrusion detection system according to the present invention.
Figure 4:
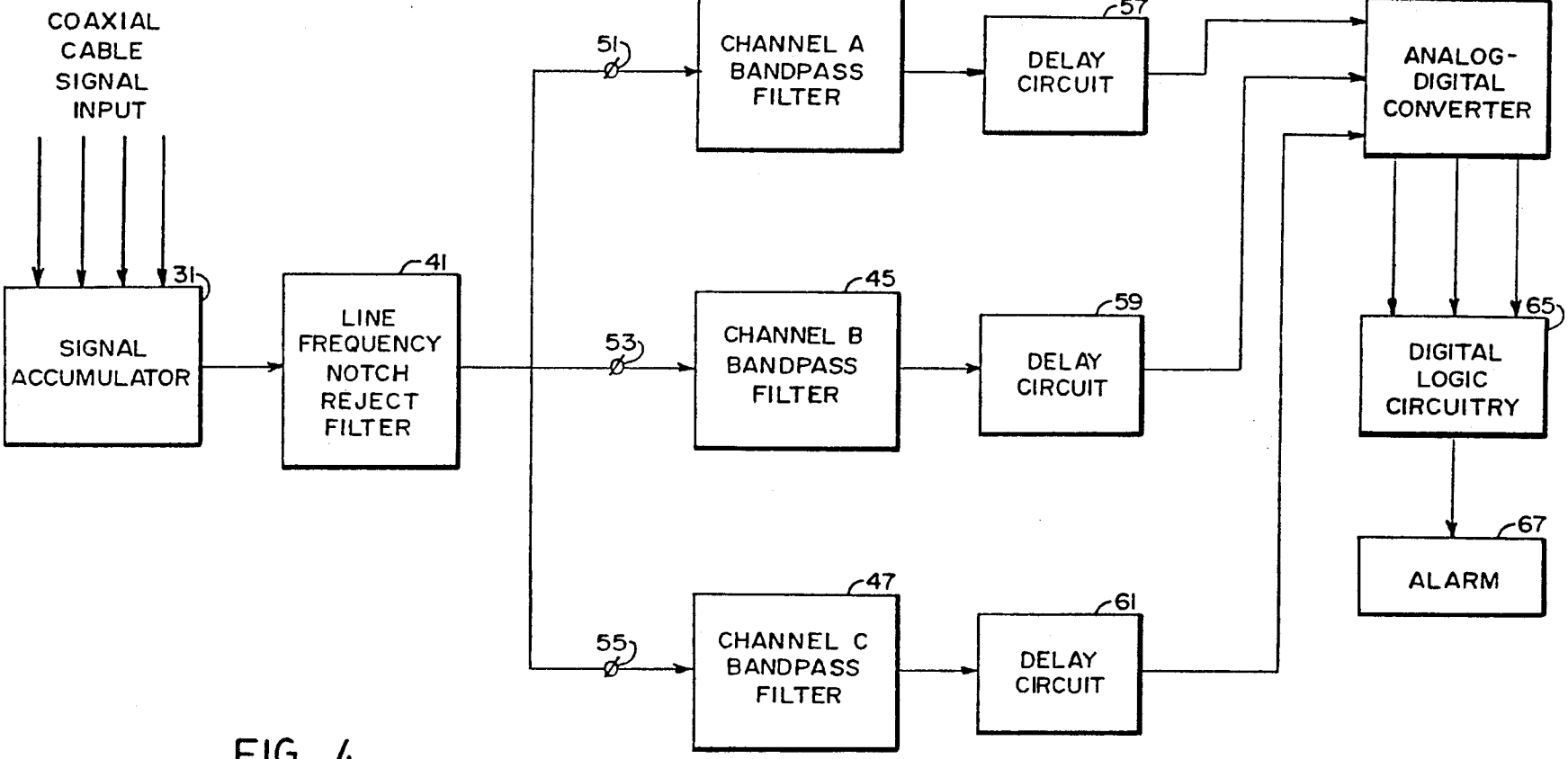
FIG. 4 is a more elaborate block diagram of a more refined intrusion detection system suitable for use with a coaxial cable sensor in accordance with the principles of the present invention.

The signal processing circuitry used in an association with the sensing arrangement illustrated in FIGS. 1 and 2 may be relatively simple, as exemplified in FIG. 3, or may be more complex and refined, as exemplified in FIG. 4. The specific circuitry employed will be up to the system designer in accordance with the relative importance perceived by the designer as to signals lying in various frequency ranges and in accordance with other factors that will vary considerably from situation to situation.

Referring to FIG. 3, a set of input signals from an array of coaxial cables (four being illustrated by way of example in FIG. 3) passes as inputs to a signal accumulator 31. In a simple case the signal accumulator 31 may simply be a connection terminal. In some cases, as for example those illustrated in FIGS. 1 and 2, only one coaxial cable is used, in which case the signal accumulator 31 may be omitted and the coaxial cable signal passe direct to the filter 33.

The signal is passed by signal accumulator 31 to a bandpass filter 33 (which may, in some situations, simply be a low-pass filter passing frequencies no higher than, say, 30 Hz). Such low frequencies will generally be of interest for intrusion detection at deflectable barriers. In order to eliminate spurious signals that persist for too short a time to represent an intrusion, the output of the bandpass filter 33 is passed through a delay circuit 35 (which may be a relatively simple resistor-capacitor circuit). The delay circuit 35 has the effect of rejecting spurious signals lasting only a very short time interval, and passing only to the following circuit component, namely a threshold detector 37, only those signals that persist long enough to be of interest. The threshold detector 37 rejects signals whose amplitude fails to meet a certain specified minimum amplitude value and passes to a suitable alarm circuit 39 only those signals whose amplitude exceeds the threshold for a period of time that exceeds the critical time interval established by delay circuit 35. In appropriate cases, the delay circuit 35 and threshold detector 37 may be combined into a single circuit.

FIG. 4 illustrates a more elaborate signal processor for use with the coaxial cable sensors illustrated in FIGS. 1 and 2. Again four coaxial cable signal inputs are shown by way of example. In FIG. 4, these are passed to a signal accumulator 31 as in the case of FIG. 1, which is omitted if only one such cable is used. The next stage following signal accumulator 31 is a line-frequency notch reject filter 41. This filter 41 rejects the line frequency noise at 60 Hz (in the case of North America) or 50 Hz (in the case of Europe, Japan and many other countries).

From the filter 41, the signal is passed not to one bandpass filter as in the case of FIG. 3, but rather to three bandpass filters 43, 45, 47, each of which is tuned to a different channel, designated as channels A,B,C, respectively in FIG. 4. For example, channel A might be tuned to relatively low frequencies of say less than, say, 30 Hz. Channel B might be tuned to some intermediate frequency range, known to be associated with prevailing ambient noise. Channel C might be tuned to relatively high frequencies of the sort that occur during, say, wire cutting (about 15 KHz to 30 KHz). Each of these channels is preferably provided with adjustable gain (or attenuation), schematically shown by gain controls 51, 53, 55 respectively for the three channels A, B, C. As a further refinement, the bandpass filters themselves may be tunable to selectable frequency ranges.

The outputs of the bandpass filters are passed through delay circuits 57, 59, 61 whose function is essentially the same as the function of the delay circuit 35 illustrated in FIG. 3. The outputs of the delay circuits 57, 59, and 61 are passed to an analog-digital converter 63 which provides three discrete outputs in digital form, each digital signal representing a discrete one of the output analog signals at the output of delay circuits 57, 59, and 61 respectively. These digital signals are processed by suitably selected digital logic circuitry 65, whose output in an alarm situation is transmitted to an alarm unit 67 functioning in generally the same manner as the alarm unit 39 in FIG. 3.

The specific digital logic circuitry to be chosen will again depend upon the character of the intrusion detection system chosen, the expected types of intrusion, the physical environment in which the system is disposed (including the ambient noise situation in that environment), etc. Note that an intermediate frequency ambient noise bandpass filter as has been hypothesized for channel B in the foregoing discussion, can be used as an inhibiting signal. If, for example, ambient noise increases generally, the threshold level at which an alarm situation is indicated in channels A and C may be increased, since it may be expected that as ambient noise generally increases, so the chances of having a false alarm signal in channels A and C will also increase. So the threshold in which channels A and C indicate an alarm condition can be raised as ambient noise increases. Precisely how many different bandpass channels are chosen and precisely what interpretation is given the signals will depend upon the designer's judgment as to the specific installation and especially the physical characteristics of that installation and the surrounding environment. The present invention is not concerned with that kind of selection but rather with the means of providing an input to the signal processor that is suitable for processing in the manner exemplified by the circuitry shown in generic fashion in FIGS. 3 and 4.

Further modifications, refinements and improvements will readily occur to those skilled in the art. The invention is not to be limited to what is specifically described but is to be given the full scope presented in the appended claims.

What is claimed is:

1. An intrusion detection system comprising:

an intrusion barrier;

a deflection-sensitive coaxial cable sensor for sensing deflection of the barrier by experiencing a corresponding deflection and producing an output signal representing such deflection when the cable sensor is thereby deformed, causing relative movement between inner and outer conductors of the coaxial cable sensor;

mounting means for mounting the coaxial cable sensor on the intrusion barrier, whereby deflection of the intrusion barrier is translated into a deflection of the coaxial cable sensor; and a signal processor receiving the output signal from the coaxial cable sensor and providing an output affirmative signal if the amplitude of the output signal from the sensor within a predetermined frequency range of less than about 100 Hz exceeds a predetermined level for a predetermined period of time.

2. A system as defined in claim 1, wherein the predetermined frequency range is selected to lie below about 30 Hz.

3. A system as defined in claim 1, additionally including a resistor connected to and terminating the cable sensor at the end thereof remote from the signal processor.

4. A system as defined in claim 3 wherein the coaxial cable sensor is a substantially uniformly noisy cable, and wherein the impedance of the cable and of the resistor are selected to attenuate signals of frequency higher than about 100 Hz.

5. An intrusion detection system comprising:

an intrusion barrier having components that freely deflect in response to a moving object making physical contact with the barrier;

a deflection-sensitive coaxial cable for sensing deflection of the barrier, said cable having an inner conductor and an outer conductor in the form of a surrounding conductive sheath insulated from the inner conductor and constructed to permit relative movement between the inner and outer conductors; wherein relative movement between the inner conductor of the cable and the conductive sheath of the cable, when the cable experiences a deflection corresponding to the deflection of the barrier and is thereby deformed, causes generation of an electrical signal;

means for mounting the cable to said components at spaced intervals along the intrusion barrier, whereby deflection of said components correspondingly deflects and thereby deforms the cable, thereby causing generation of said electrical signal; and a signal processor connected to one end of the cable and receiving the electrical signal from the cable and responsive to frequency components of the signal below about 30 Hz and generating an affirmative output signal whenever certain characteristics of the component of the cable electrical signal below about 30 Hz are present.

6. A system as defined in claim 5, wherein the signal processor comprises:

a filter for passing signals of a predetermined frequency range below about 30 Hz;

a delay circuit for rejecting signals within said frequency range that persist for a time shorter than a predetermined threshold time; and a threshold detector for passing only signals whose amplitude exceeds a predetermined threshold amplitude for a time exceeding the threshold time.

7. A system as defined in claim 5, wherein the signal processor comprises:

a plurality of filters each of which passes signals of a discrete predetermined frequency range at least one of which is below about 30 Hz, and each of which receives the electrical signal from the cable;

a delay circuit for each filter for rejecting signals within the frequency range passed by the associated filter that persist for a time shorter than a predetermined threshold time;

a threshold detector for each filter for passing only signals within the associated frequency range whose amplitude exceeds a predetermined threshold amplitude for a time exceeding the associated threshold time; and means responsive to the threshold detectors for generating said affirmative output signal when a predetermined combination of signals are passed by the various threshold detectors.

8. A system as defined in claim 7, wherein said responsive means comprises logic circuitry.

9. A system as defined in claim 5, wherein the signal processor responds selectively to constituents of the electrical signal of the cable lying within predetermined discrete frequency ranges, and generates said affirmative output signal only when the mix of such constituents satisfies predetermined criteria.

10. A system as defined in claim 9, wherein the signal processor includes an analog-digital converter for transforming an analog output signal corresponding to each of said constituents to a discrete associated digital signal and logic circuitry for receiving the digital signal representing said constituents.

11. On or for use with an intrusion barrier, the combination comprising: a deflection-sensitive coaxial cable sensor for sensing deflection of the barrier by deforming in response thereto thereby to produce an output signal representing such deflection of the barrier;

mounting means for mounting the coaxial cable sensor on the intrusion barrier, whereby deflection of the intrusion barrier is translated into a consequent corresponding deflection of the coaxial cable sensor; and a signal processor receiving the output signal from the coaxial cable sensor and providing an output affirmative signal if the amplitude of the output signal from the sensor within a predetermined frequency range of less than about 100 Hz exceeds a predetermined level for a predetermined period of time.

12. The combination of claim 10, additionally including a resistor connected to and terminating the cable sensor at an end thereof remote from the signal processor.

13. The combination of claim 12, wherein the coaxial cable sensor is a substantially uniformly noisy cable and wherein the impedance of the cable and of the resistor are selected to attenuate signals of frequency higher than about 100 Hz.

14. On or for use with an intrusion barrier having components that freely reflect in response to a moving object making physical contact with the barrier, the combination comprising:

a deflection-sensitive coaxial cable for sensing deflection of the barrier, said cable having an inner conductor and an outer conductor in the form of a surrounding conductive sheath insulated from the inner conductor, and constructed to permit relative movement between the inner and outer conductors; wherein relative movement between the inner conductor of the cable and the conductive sheath of the cable, when the cable experiences a deflection corresponding to the deflection of the barrier and is thereby deformed, causes generation of an electrical signal;

means for mounting the cable to said components at spaced intervals along the intrusion barrier, whereby deflection of said components correspondingly deflects and thereby deforms the cable, thereby causing generation of said electrical signal; and a signal processor connected to one end of the cable and receiving the electrical signal from the cable and responsive to frequency components of the signal below about 30 Hz and generating an affirmative output signal whenever certain characteristics of the component of the cable electrical signal below about 30 Hz are present.

15. The combination of claim 14, wherein the signal processor comprises:

a filter for passing signals of a predetermined frequency range below about 30 Hz;

a delay circuit for rejecting signals within said frequency range that persist for a time shorter than a predetermined threshold time; and a threshold detector for passing only signals whose amplitude exceeds a predetermined threshold amplitude for a time exceeding the threshold time.

16. The combination of claim 12, additionally including a resistor connected to and terminating the cable at the end thereof remote from the signal processor.

17. The combination of claim 16, wherein the coaxial cable is a substantially uniformly noisy cable and wherein the impedance of the cable and of the resistor are selected to attenuate signals of frequency higher than about 100 Hz.

18. The combination of claim 14, wherein the signal processor comprises:

a plurality of filters each of which passes signals of a discrete predetermined frequency range at least one of which is below about 30 Hz, and each of which receives the electrical signal from the cable;

a delay circuit for each filter for rejecting signals within the frequency range passes by the associated filter that persist for a time shorter than a predetermined threshold time;

a threshold detector for each filter for passing only signals within the associated frequency range whose amplitude exceeds a predetermined threshold amplitude for a time exceeding the associated threshold time; and means responsive to the threshold detectors for generating said affirmative output signal when a predetermined combination of signals are passed by the various threshold detectors.

19. The combination of claim 13, additionally including a resistor connected to and terminating the cable at the end thereof remote from the signal processor.

20. The combination of claim 19, wherein the coaxial cable is a substantially uniformly noisy cable and wherein the impedance of the cable and of the resistor are selected to attenuate signals of frequency higher than about 100 Hz.

21. The combination of claim 11, additionally including a resistor connected to and terminating the cable at the end thereof remote from the signal processor.

22. The combination of claim 21, wherein the coaxial cable is a substantially uniformly noisy cable and wherein the impedance of the cable and of the resistor are selected to attenuate signals of frequency higher than about 100 Hz.

* * * * *